US006099920A

United States Patent [19]

Kao

[11] Patent Number: 6,099,920

[45] Date of Patent: Aug. 8, 2000

[54] ARTIFICIAL CHRISTMAS TREE AND METHOD OF MOUNTING BRANCHES THEREON

[76] Inventor: Cheung Chong Kao, 17/F., Eight Commercial Tower, 8 Sun Yip Street, Chai Wan, The Hong Kong Special Administrative Region of the People's Republic of China

[21] Appl. No.: 08/922,994

[22] Filed: Sep. 2, 1997

[51] Int. Cl.[7] ..... A47G 33/06

[52] U.S. Cl. ..... 428/18; 428/19

[58] Field of Search ..... 428/18, 19; D11/118, D11/130

[56] References Cited

U.S. PATENT DOCUMENTS

| | | | |
|---|---|---|---|
| 3,214,318 | 10/1965 | Snow | 428/18 |
| 3,278,364 | 10/1966 | Diffenbach | 428/18 |
| 3,499,818 | 3/1970 | Kent | 428/18 |
| 3,616,102 | 10/1971 | Baus | 428/18 |
| 3,728,202 | 4/1973 | Baus et al. | 428/18 |
| 3,834,976 | 9/1974 | Mottel | 428/18 |

FOREIGN PATENT DOCUMENTS

| | | |
|---|---|---|
| 1230984 | 12/1966 | Germany . |
| 944472 | 12/1963 | United Kingdom . |

*Primary Examiner*—Mark L. Bell
*Assistant Examiner*—David Sample
*Attorney, Agent, or Firm*—Wood, Herron & Evans, LLP; A. Ralph Navaro, Jr.

[57] ABSTRACT

An artificial tree has a trunk (2), at least one tubular bracket (4) for fitting on the trunk, a fixing ring (6) and a branch (12) having a stem portion, wherein the tubular bracket (4) defines an opening for insertion of an end of the stem, the fixing ring (6) being adapted to fit over the tubular bracket and to be deformable so as to tightly grip the tubular bracket.

21 Claims, 6 Drawing Sheets

ARTIFICIAL CHRISTMAS TREE AND METHOD OF MOUNTING BRANCHES THEREON

BACKGROUND OF THE INVENTION

The present invention relates to an artificial tree and to a method for mounting branches on such an artificial tree.

In artificial trees such as Christmas trees, and in particular in larger trees of superior quality the central trunk is generally formed of a metal pole to which the branches are attached by means of separate bracket pieces. These include portions, one for each branch, to which the respective branches are attached, by a pivot or hinge in a manner which allows a degree of movement. This construction is however relatively expensive and troublesome to manufacture and time-consuming to assemble. It also has an unnatural appearance due to the construction of the bracket and pivots or hinges.

The present invention seeks to provide an arrangement which is more easily manufactured and assembled.

SUMMARY OF THE INVENTION

According to a first aspect of the present invention there is provided an artificial tree comprising a trunk, at least one tubular bracket for fitting on the trunk, a fixing member, and at least one branch having a stem portion, wherein the tubular bracket at least partly defines an opening for insertion of an end of the branch stem portion, the fixing member being adapted to fit over the tubular bracket and to be deformable so as to tightly grip the tubular bracket.

The arrangement allows a branch to be simply yet firmly attached on the tree trunk.

Preferably, an artificial tree according to claim 1 wherein the fixing member is a metal ring which overlies the tubular bracket and may be stamped whereby the ring is compressed onto the tubular bracket.

The stem of the branch is formed of a metal wire which has an elongate cross-section such that when fitted may be bent by a user towards or away from the trunk. This allows the branches to be folded flat during storage and transport, and folded out into the desired shape by the user.

In the preferred embodiment the bracket is formed of plastics and is formed with a plurality of longitudinally-extending grooves which define with the trunk the openings for insertion of the branch stem. The grooves are formed in outwardly-protruding portions.

In a further aspect the invention resides in an artificial tree comprising a trunk, at least one tubular bracket fitted on the trunk, and at least one branch having a stem portion fitted in an opening at least partly defined by the tubular bracket, and a fixing member which fits over the tubular bracket so as to tightly grip the tubular bracket.

In a still further aspect the invention resides in an artificial tree comprising a trunk, at least one branch, and securing means for securing the branch onto the trunk, the branch including a branch stem formed of a metal wire of elongate cross-section, whereby the branch may be bent by a user, towards or away from the trunk.

This allows a tree to be provided in which the branches can be arranged in a compact arrangement for ease of storage and transport, and easily bent into natural-looking arrangement by the user, as desired.

In a still further aspect the invention resides in a method of mounting at least one branch to the trunk of an artificial tree which has at least one tubular bracket and a fixing member, the branch having a branch stem portion, the method comprising the steps of:

(a) Inserting the tubular bracket and fixing member onto the trunk so that the fixing member fits over the tubular bracket;

(b) fitting the or each branch on the trunk by inserting the end of the stem portion into an opening or respective openings at least partly defined by the tubular bracket; and (c) deforming the fixing member so as to tightly grip the tubular bracket and branch stem or stems therein.

Preferably, the fixing member is a fixing ring, and wherein in the step (c) the fixing member is deformed by a stamping operation to grip the tubular bracket therein. The tubular bracket is provided with at least one longitudinally-extending groove which defines with the trunk the insertion opening, the branch stem being inserted into the said opening at step (b). Each branch may be fitted such that the branch extends generally parallel to the trunk and is subsequently bent away from the trunk to extend more radially therefrom. Before step (b) the tubular bracket is secured onto the trunk with a pin or staple forced through the tubular bracket and into the trunk.

BRIEF DESCRIPTION OF DRAWINGS

An embodiment of the invention is now described, by way of example only, with reference to the following drawings in which.

Figure 1:
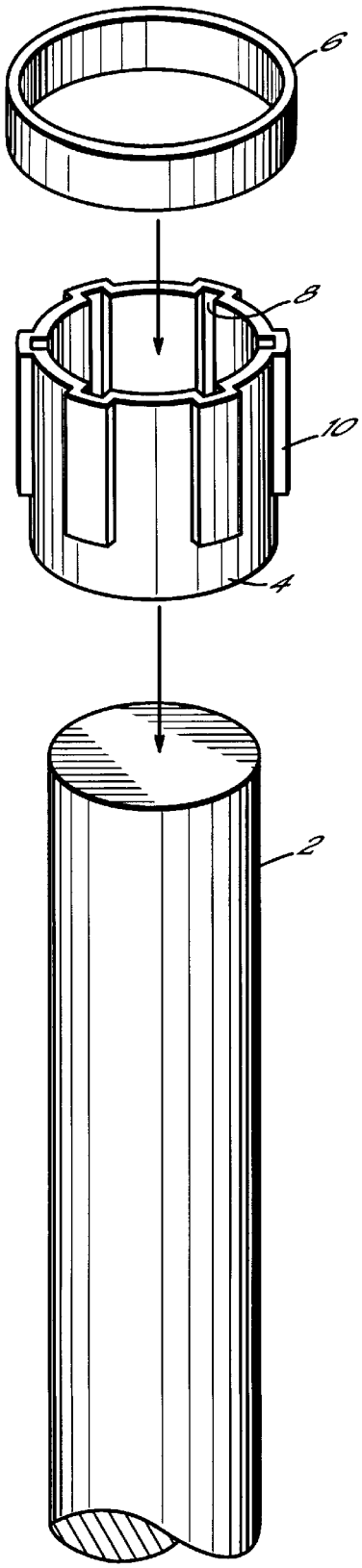
FIG. 1 shows the step of fitting a branch-supporting bracket and fixing collar onto a tree trunk.

Turning firstly to FIG. 1, this shows a tree trunk 2 in the form of an elongate pole, a fixing bracket 4 and a fixing collar 6. The trunk 2 may be made of wood, or more preferably made of a hollow metal tube. In the complete tree the trunk may be made up of a number of trunk sections which are connected together by suitable attachment means, or alternatively may comprise a single-piece trunk.

The bracket 4 comprises a tubular sleeve formed with a plurality of internal grooves 8 which extend into externally protruding portions 10. The protruding portions 10 extend from an upper region of the bracket towards a lower region, but do not extend along the entire axial length thereof. The grooves 8 are open at their upper ends, and closed at their lower ends. The bracket 4 is preferably formed of a moulded plastics material which is light yet relatively rigid, and easy to form in the illustrated shape.

The collar ring 10 comprises a metal ring which is of an internal diameter which is about equal or slightly larger than the external diameter of the bracket 4, including the protruding portions 10.

Figures 2, 2A:
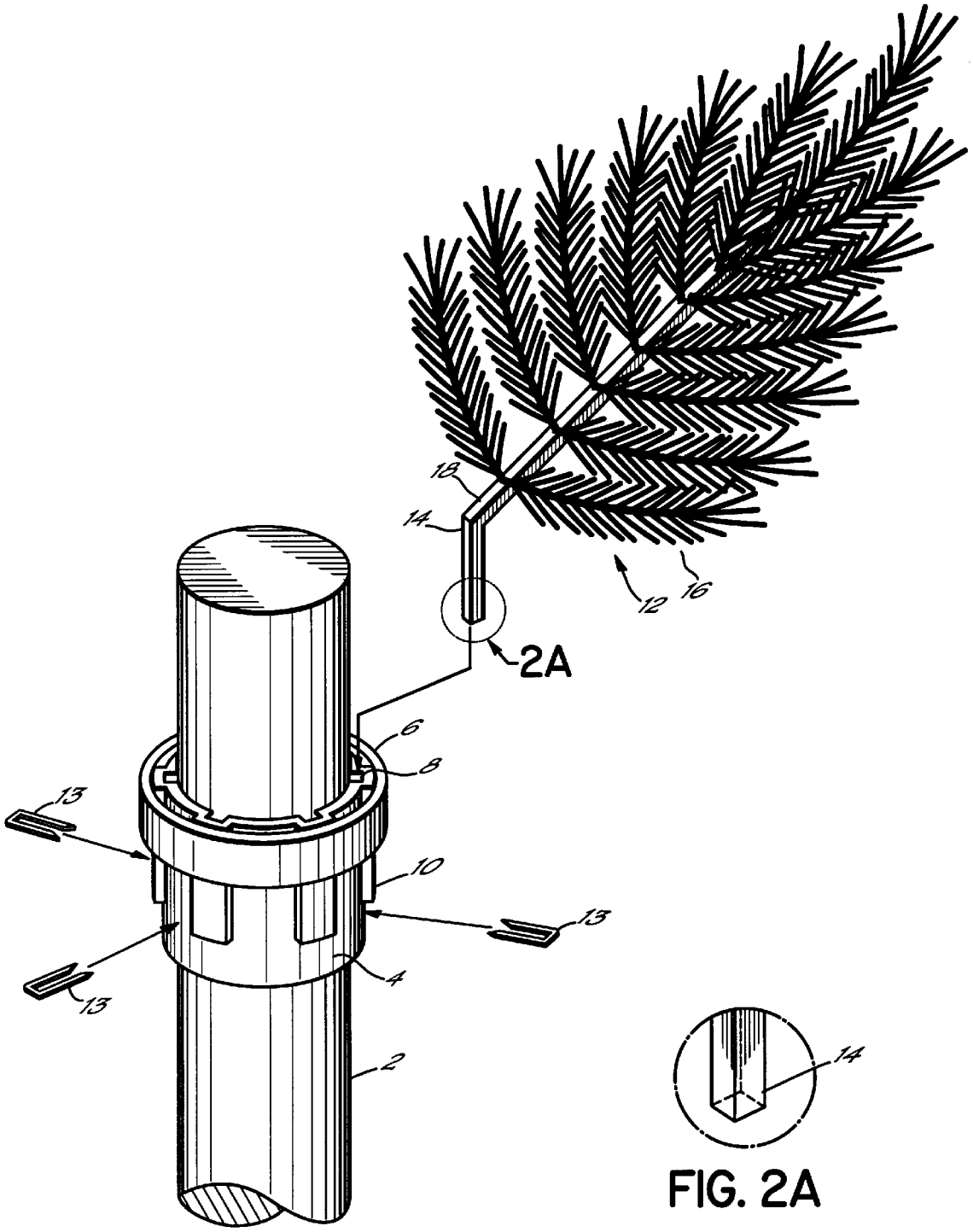
FIG. 2 shows the securing of the bracket and the insertion of a branch into the bracket.

FIG. 2 shows a branch 12 which has a wire stem 14 having a substantially straight end portion, and a bend at 18, and a substantially straight main stem portion from which extend a plurality of fronds 16. The stem 14 comprises a piece of wire of elongate cross-section as indicated in the inset of FIG. 2, such that the wire can be bent with relative ease in the short direction of its cross-section, but is difficult to bend in the long direction.

The fronds 16 are made of a synthetic material such as a vinyl or other plastics material to give the appearance of a real tree, leaves or needles.

Figure 3:
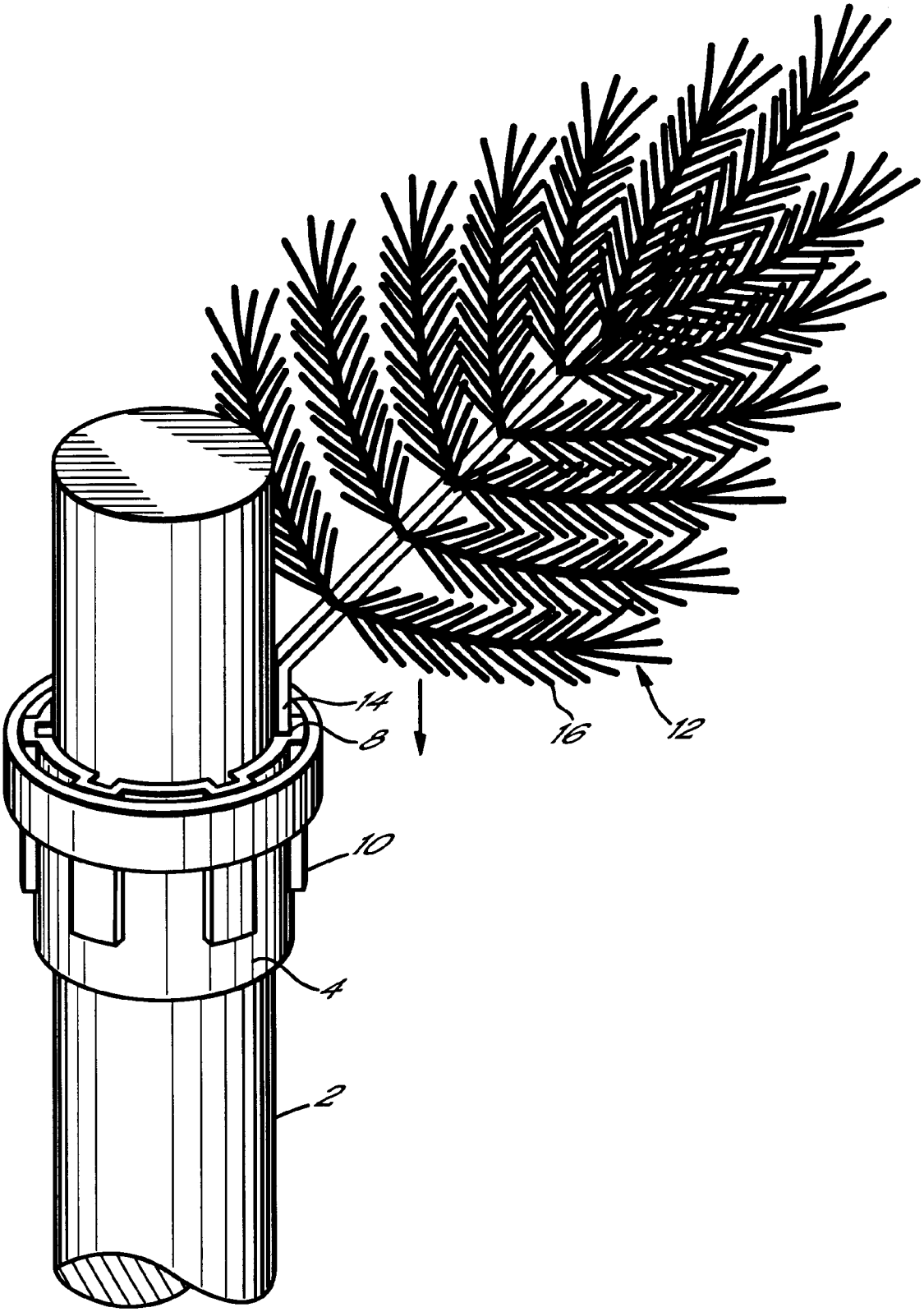
FIG. 3 shows a branch partly inserted into the bracket.
Figure 4:
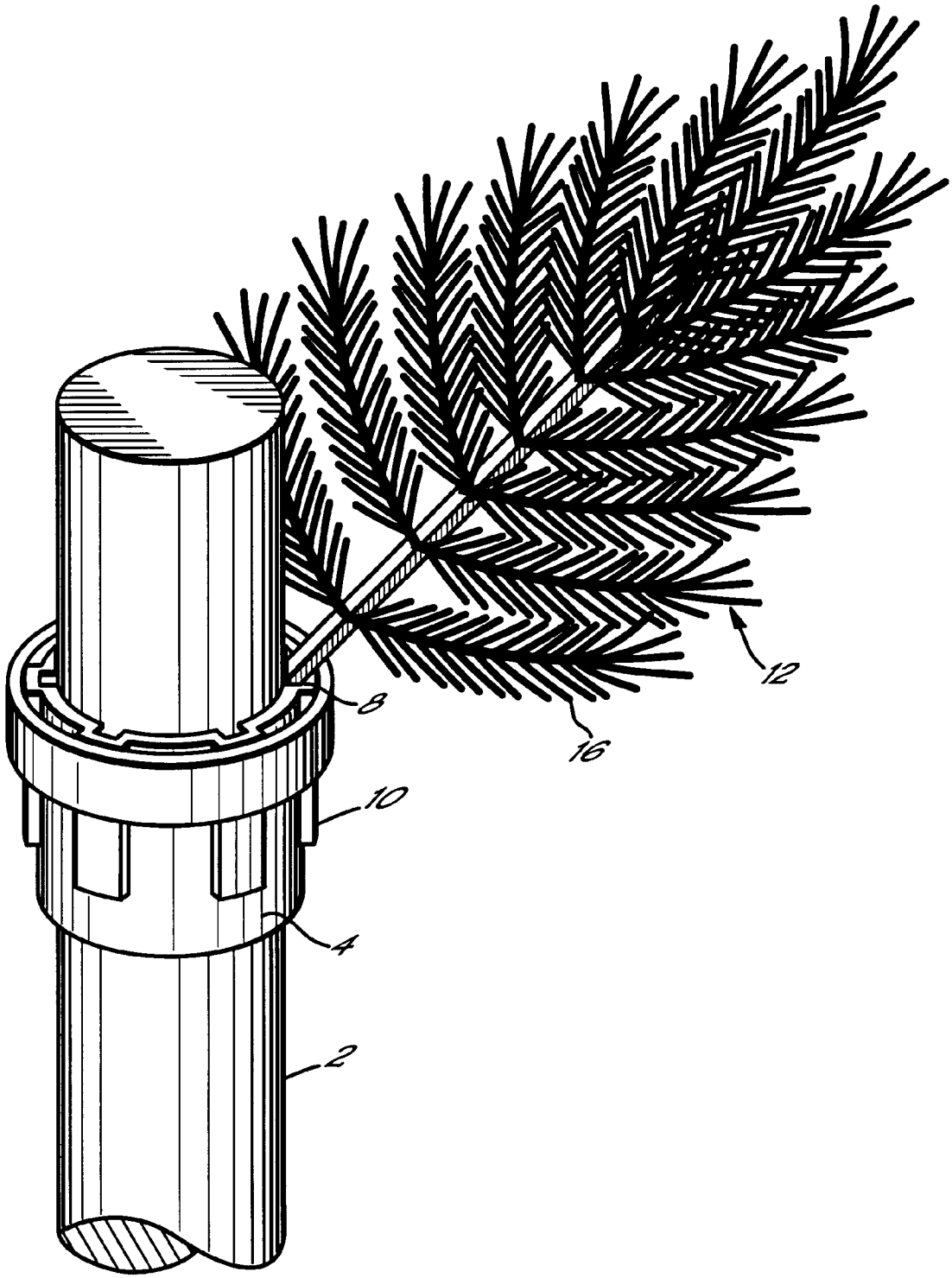
FIG. 4 shows the inserted the branch fitted in the bracket.

The process of assembly is now described. As indicated in FIG. 1, the bracket 4 is first fitted onto the trunk 2, followed by the ring 6 which is push-fitted onto an upper region of the bracket 4. The bracket 4 is then secured onto the trunk by means of U-shaped pins or staples 13 which are forced through the bracket and into the trunk by means of pneumatic gun. Subsequently, the end of stem 14 of the branch 12 is push-fitted into the top of a groove 8 as far as the bend 18 in the stem 14, as indicated in FIGS. 3 and 4. This is repeated for other branches 12 (although these are not shown in the Figures for reasons of clarity). Once each of the branches 12 are fitted the trunk is placed in a stamping machine which holds the trunk 2 and deforms the collar 6 inwardly in a stamping operation so as to grip the bracket 4 tightly, thereby holding the branches 12 tightly in the grooves 8 of the bracket.

The tree with the branches fitted in this way can be packaged in a relatively slim box or other container for convenient storage and shipping.

Figure 5:
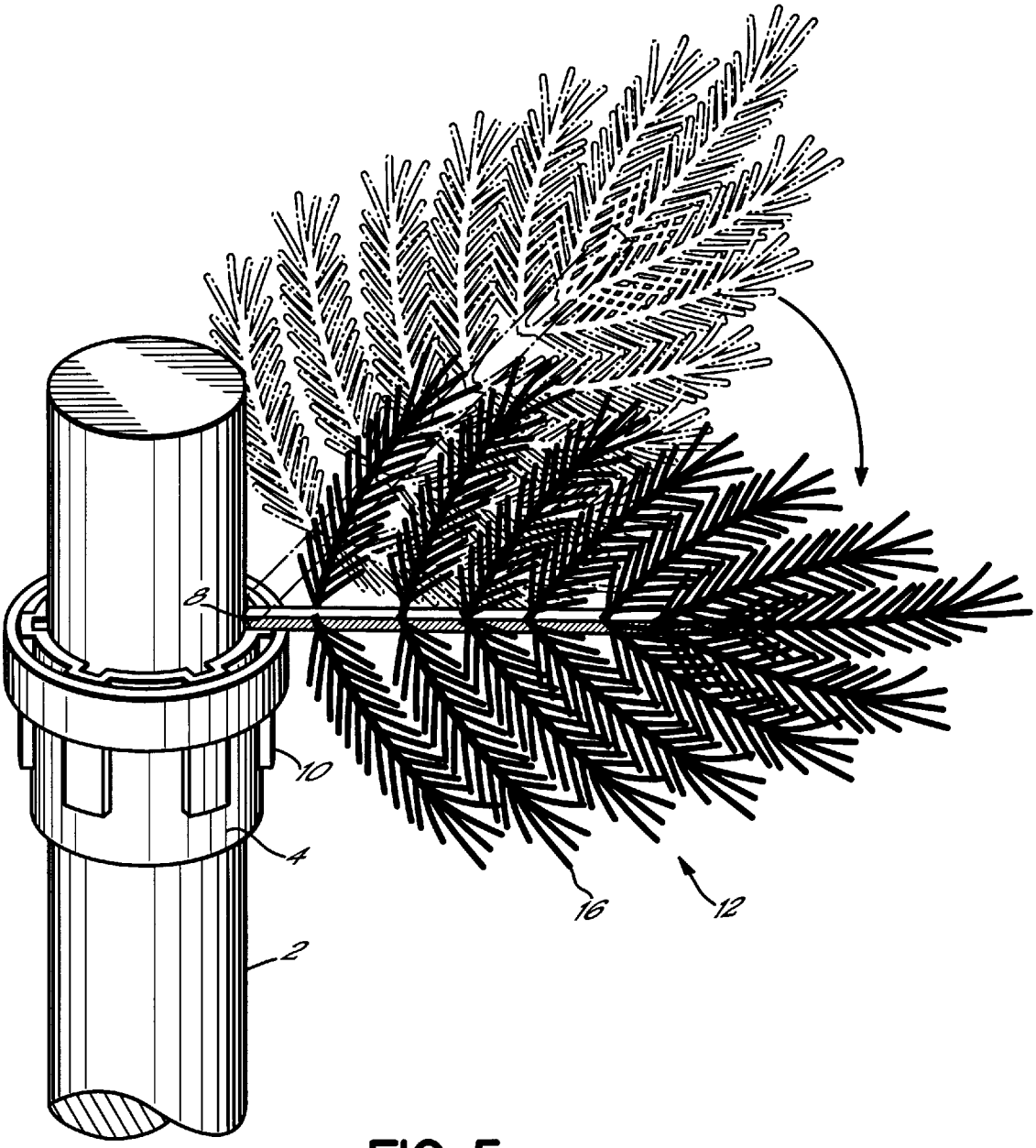
FIG. 5 shows the bending of a branch into a desired position.
Figure 6:
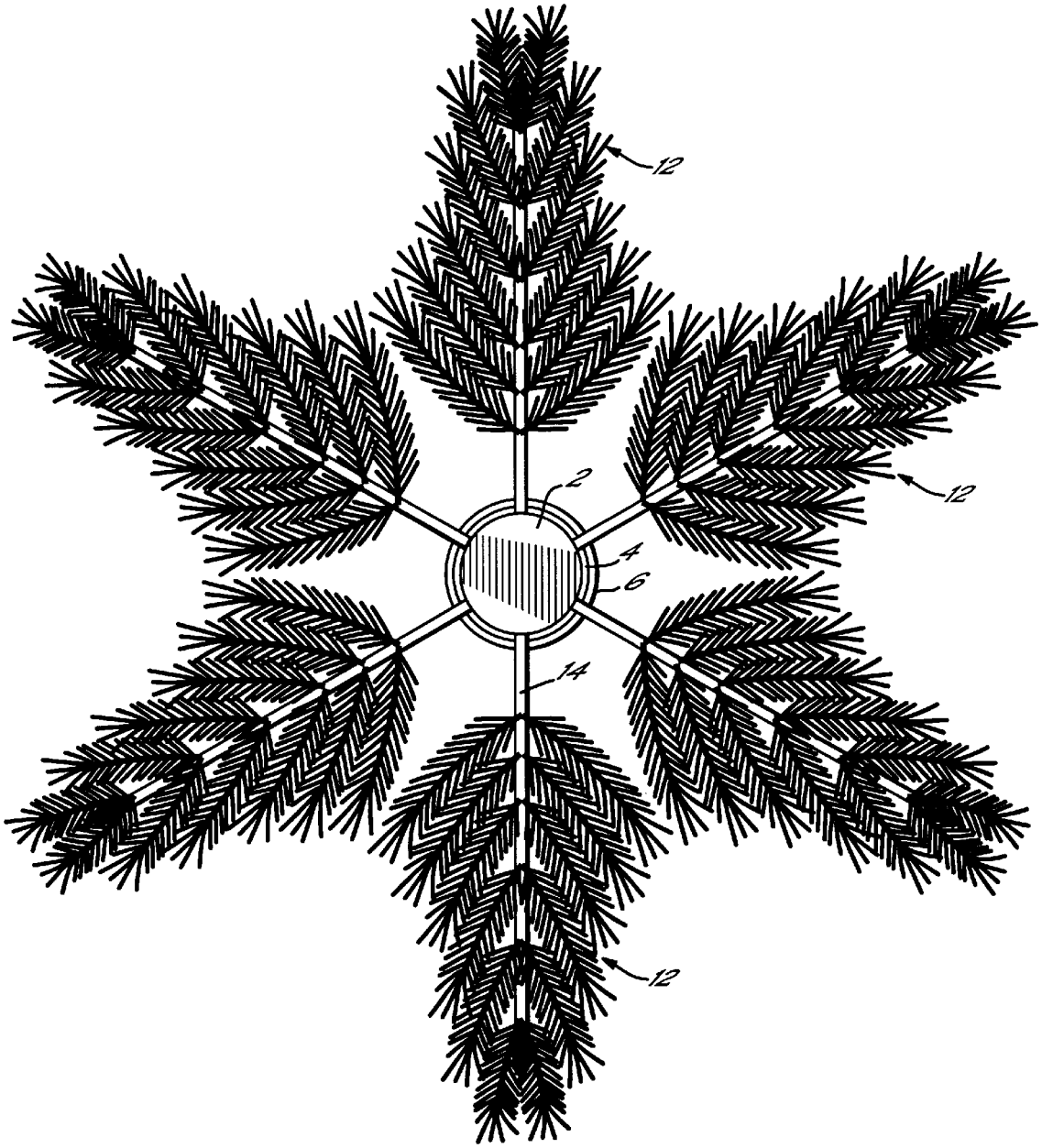
FIG. 6 is a view from above showing a plurality of branches fitted onto the tree trunk.

Once purchased, the consumer setting up the tree may easily bend each branch 12 downwardly so as to extend substantially radially from the bracket 4, as indicated in FIG. 5. The exact angle can be adjusted by the user as desired, so as to give the tree a realistic appearance. FIG. 6 shows six branches 12 fitted onto the bracket 4 and bent into a radial orientation.

Although only a single bracket 4 is shown, it will be appreciated that in the complete tree a plurality of brackets 4 and rings 6 are arranged at spaced intervals along the trunk 2 with branches fitted thereto as described above.

When the user wishes to store the tree, the user can bend the branches inwardly up towards the position shown in FIG. 4.

What is claimed is:

1. An artificial tree comprising a trunk, at least one tubular bracket for fitting on the trunk, a fixing member, and at least one branch having a stem portion, wherein the tubular bracket at least partly defines an opening for insertion of an end of the branch stem portion, the fixing member being adapted to fit over the tubular bracket and to be deformable so as to tightly grip the tubular bracket, wherein the stem of the branch is formed of a metal wire which has an elongate cross-section such that when fitted the or each branch may be bent by a user towards or away from the trunk.

2. An artificial tree according to claim 1 wherein the fixing member is a metal ring which overlies the tubular bracket and may be stamped whereby the ring is compressed onto the tubular bracket.

3. An artificial tree according to claim 1 wherein the bracket is formed with a plurality of longitudinally-extending grooves which define with the trunk the openings for insertion of the branch stem.

4. An artificial tree according to claim 3 wherein the grooves are formed in outwardly-protruding portions.

5. An artificial tree according to claim 1 wherein the tubular bracket is formed of plastics material.

6. An artificial tree comprising a trunk, at least one tubular bracket for fitting on the trunk, a fixing member, and at least one branch having a stem portion, wherein the tubular bracket at least partly defines an opening for insertion of an end of the branch stem portion, the fixing member being adapted to fit over the tubular bracket and to be deformable so as to tightly grip the tubular bracket, wherein the bracket is formed with a plurality of longitudinally-extending grooves which define with the trunk the openings for insertion of the branch stem.

7. An artificial tree according to claim 6, wherein the grooves are formed in outwardly-protruding portions.

8. An artificial tree comprising a trunk, at least one tubular bracket fitted on the trunk, and at least one branch having a stem portion fitted in an opening at least partly defined by the tubular bracket, and a fixing member which fits over the tubular bracket and is deformed so as to tightly grip the tubular bracket.

9. An artificial tree according to claim 8 wherein the fixing member is a metal ring stamped to compress the tubular bracket therein.

10. An artificial tree according to claim 8 wherein the stem of the branch is formed of a metal wire which has an elongate cross-section.

11. An artificial tree according to claim 8 wherein the bracket is formed with a plurality of longitudinally-extending grooves which define with the trunk the openings in which the branch stem portions are fitted.

12. An artificial tree according to claim 11 wherein the grooves are formed in outwardly-protruding portions.

13. An artificial tree according to claim 8 wherein the tubular bracket is formed of plastics.

14. An artificial tree comprising a trunk, at least one tubular bracket fitted on the trunk, and at least one branch having a stem portion fitted in an opening at least partly defined by the tubular bracket, and a fixing member which fits over the tubular bracket so as to tightly grip the tubular bracket, wherein the stem of the branch is formed of a metal wire which has an elongate cross-section.

15. An artificial tree comprising a trunk, at least one tubular bracket fitted on the trunk, and at least one branch having a stem portion fitted in an opening at least partly defined by the tubular bracket, and a fixing member which fits over the tubular bracket so as to tightly grip the tubular bracket, wherein the bracket is formed with a plurality of longitudinally-extending grooves which define with the trunk the openings in which the branch stem portions are fitted.

16. An artificial tree according to claim 15 wherein the grooves are formed in outwardly-protruding portions.

17. A method of mounting at least one branch to the trunk of an artificial tree which has at least one tubular bracket and a fixing member, the branch having a branch stem portion, the method comprising the steps of:

(a) Inserting the tubular bracket and fixing member onto the trunk so that the fixing member fits over the tubular bracket;

(b) fitting the or each branch on the trunk by inserting the end of the stem portion into an opening or respective openings at least partly defined by the tubular bracket; and (c) deforming the fixing member so as to tightly grip the tubular bracket and branch stem or stems therein.

18. A method according to claim 17 in which the fixing member is a fixing ring, and wherein in step (c) the fixing member is deformed by a stamping operation to grip the tubular bracket therein.

19. A method according to claim 17 in which the tubular bracket is provided with at least one longitudinally-extending groove which defines with the trunk the insertion opening, the branch stem being inserted into the said opening at step (b).

20. A method according to claim 17 wherein the or each branch is fitted such that the branch extends generally parallel to the trunk and is subsequently bent away from the trunk to extend more radially therefrom.

21. A method according to claim 17 in which before step (b), the tubular bracket is secured onto the trunk with a pin or staple forced through the tubular bracket and into the trunk.

* * * * *